US006941699B2

(12) United States Patent
Parsons

(10) Patent No.: US 6,941,699 B2
(45) Date of Patent: Sep. 13, 2005

(54) STRUCTURAL SUPPORT FOR HORIZONTALLY OPENABLE WINDOWS

(76) Inventor: Steven Anthony Parsons, 2527 W. Keys La., Anaheim, CA (US) 92804

( * ) Notice: Subject to any disclaimer, the term of this patent is extended or adjusted under 35 U.S.C. 154(b) by 0 days.

(21) Appl. No.: 10/359,947

(22) Filed: Feb. 6, 2003

(65) Prior Publication Data

US 2004/0154226 A1 Aug. 12, 2004

(51) Int. Cl.[7] ..... E05F 11/38
(52) U.S. Cl. ..... 49/323; 49/324; 49/360
(58) Field of Search ..... 49/323, 324, 360, 49/363; 52/72, 200; 160/102

(56) References Cited

U.S. PATENT DOCUMENTS 2,374,618 A * 4/1945 Perreton ..... 49/153
4,969,291 A * 11/1990 Camara ..... 49/71
5,535,551 A * 7/1996 Falk et al. ..... 49/324
6,070,637 A 6/2000 Jancan

* cited by examiner

*Primary Examiner*—Jerry Redman

(74) *Attorney, Agent, or Firm*—Morriss O'Bryant Compagni

(57) ABSTRACT

A structural latticework frame design, fixed end, cantilevered, or collapsible, on a horizontally openable window, wherein the lattice work frame is used for structural value in the open position. This design allows for the load from the glass and sash to be transferred through the latticework frame to the housing to carry the load, which simplifies the mechanism needed to open and close the window.

19 Claims, 17 Drawing Sheets

STRUCTURAL SUPPORT FOR HORIZONTALLY OPENABLE WINDOWS

BACKGROUND OF THE INVENTION

1. Field of the Invention

This invention relates to windows that can be opened outwardly in a horizontal projecting direction, and specifically, it relates to a structural support design for a horizontally projecting openable window wherein the window sash is reinforced by a structural lattice work and moves along one or more horizontal supports with the aid of rollers, bearings or some other similar friction reducing method which design reduces the effort needed to open and shut the window.

2. Description of the Related Art

Windows have been known and used for centuries in buildings and other enclosed structures, such as vehicles, and most are made to open. Openable windows have typically opened either in a vertical direction or have been pivotally connected to an unmovable structure, such as a window frame or casement, so that the window can be pivotally rotated about that connection point to move part of the window outwardly and part of the window inwardly relative to the stationary structure. The common example of vertically openable windows is double hung windows. An example of rotating windows is a ventilated sky light/window which pivotally rotates about a central connection point in the casement.

While such openable windows are functional and suitable for the intended purpose of providing ventilation, they each have disadvantages or limitations which render conventional windows unsuitable for all purposes. For example, the most prevalent concern about conventional windows is their ability to be broken into. With vertically opened windows, the glass can be broken, the latch opened, and the window slid open to provide an entryway for a burglar. As a result, windows cannot be left open to provide ventilation for fear that unlawful entry may occur. The same is true of pivotally hung windows although they may provide slightly less opportunity for enabling unlawful entry.

Another concern regarding conventional windows is if a wind storm arises, dust, dirt and other air-borne debris can blow into an open window and introduce the unwanted material into the building. This design allows for a filtering device to be installed without obstructing the view out the window. Additionally, conventional windows are inherently unsafe when open because objects can be thrown out of them with possible injury to persons outside, or people can accidentally fall out of open windows. As a result, conventionally openable windows are not installed in high-rise buildings, hospitals or other institutions without the addition of stops. Stops are characteristically installed to allow no more than 4" to 6" of access. Thus, the occupants of such structures are deprived of the benefit of natural ventilation.

Still another disadvantage of conventional windows is the fact that the manner in which the window opens may obstruct the view out of the remainder of the window. This is especially true where a mesh screen is mounted on the window. That problem is particularly acute with windows that are pivotally hung since the window swings partially outward from the casement and partially inward and a portion of the window is most likely obstructing the view at one time or another. Additionally, pivotally hung windows must be able to swing out freely without hitting bushes or trees, or without contacting furniture or fixtures within the building.

One window design that addresses the shortcomings of conventional windows is the horizontally openable window. The horizontally openable window is designed to be openable, while still providing security, unobstructed view, ease of installment and virtually unrestricted placement for installation. The horizontally openable window is structured to be openable in a horizontal direction relative to the casement of the window to provide a ventilated space about substantially the entirety of the periphery of the window. Because the window moves out horizontally from the surrounding casement, the window remains substantially in its original form so that the view out of the window is not obstructed in any way. In addition, the distance that the window moves horizontally outwardly from the casement is an insufficient distance to allow human entry through the window.

U.S. Pat. No. 6,070,637 to Jancan discloses a horizontally openable window. The window sash of this horizontally openable window is supported by the same mechanism that serves to open and shut the window. This mechanism is comprised of a threaded pin and shaft type opener located at the four corners of the window. Alternatively, the mechanism comprises a scissors type opener. Because the opening means also serves as the support means, there generally is required more than one opening means. Because the multiple opening means must be operated concurrently, the window, as currently designed, results in a fairly cumbersome opening mechanism. In addition, because the opening means also supports the window, the weight of the window binds the opening means, making it more difficult, if not impossible to operate.

Thus, it would be advantageous if the support for the window sash were separate from the means for opening and shutting the window. In addition, it would be advantageous to provide a means for reducing friction between the window sash and the support in order to render easier the opening and closing of the window.

BRIEF SUMMARY OF THE INVENTION

In accordance with the present invention, the sash of a horizontally openable window is reinforced by a structural lattice work. As used in this application, the term "sash" refers to that part of the window that holds the glass, or other similarly transparent material. The sash and the structural lattice work are supported by at least one non-moving horizontal support of fixed length. The non moving horizontal support provides support for the sash and lattice as they travel in a horizontal direction between the open and closed position and is separate from the means used to open and close the window. Supporting the sash and lattice with at least one horizontal support allows for a separate mechanism to actually open and close the window.

The window may also comprise a casement to receive the window in registration with it. Where the window comprises a casement, the horizontal supports may be positioned to be in contact with the casement, or may be positioned away from the casement.

In one embodiment the lattice work comprises a rigid structure. In an alternative embodiment, the lattice work may be designed in such a manner that it can be moved, accordion-like, from an open position to a closed position The horizontal supports may be fixedly attached to the building in which the window is located by bolts, screws, nails, glue or any other similar method known to the industry. In the alternative, the horizontal supports are removably attached to the building in which the window is located by affixing plate or other mounting surface to the building in which the window is located. A support bracket may then be removably attached to and supported by the mounting surface.

The horizontal support may be comprised of two or more parts, with each part comprising at least one mounting plate and at least one horizontal beam.

The window can be configured such that the sash moves between a first end of the horizontal support and a second end of the horizontal support. In the alternative, the sash can be movably attached to the horizontal support by an apparatus that allows the sash to simultaneously move away from both the first end and the second end of the horizontal support as it moves from the closed position to the open position.

The lattice work is connected to the horizontal supports in such a manner that it can travel back and forth between an open and a closed position. In its most advantageous structure, the lattice work and the sash which is attached to it travel on rollers or bearings interposed between the horizontal supports and the lattice work. The rollers reduce friction between the sash and lattice work and the horizontal supports as the sash and lattice work move along the horizontal support. This allows the sash and lattice work to be moved between an open and a closed position with relative ease, thus allowing for a wide variety of methods to be employed to open and shut the window, including hand cranked or motorized opening devices, or simply pushing and pulling the sash by hand.

In addition, the invention includes constructing the lattice work from metal, plastic, wood, or some other suitable material in order to increase the structural strength of the window. The structural lattice work can also be formed as one unit with the sash.

BRIEF DESCRIPTION OF THE SEVERAL VIEWS OF THE DRAWINGS

In the figures, which illustrate what is currently considered to be the best mode for carrying out the invention.

DETAILED DESCRIPTION OF THE INVENTION

Figure 1:
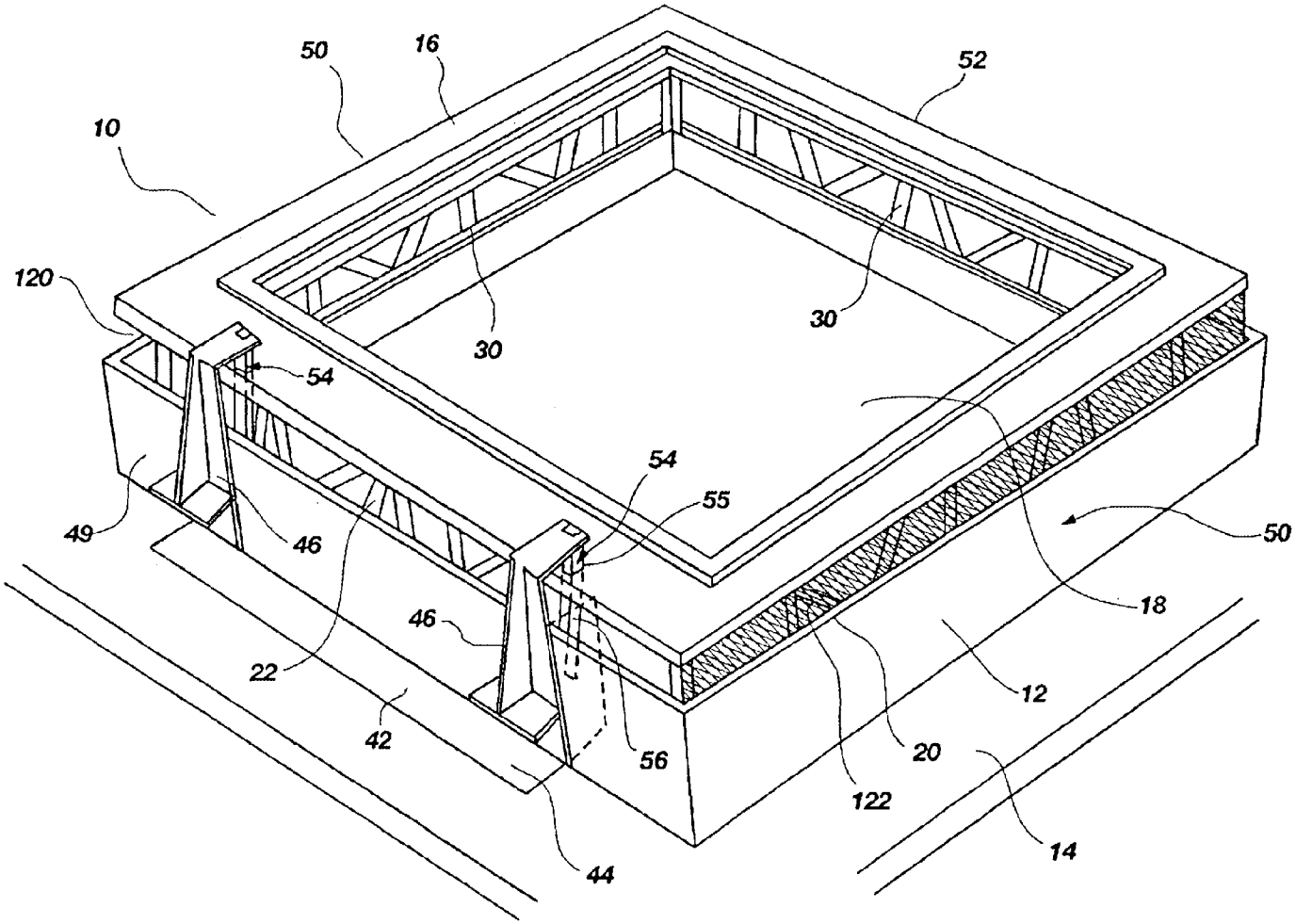
FIG. 1 depicts a perspective view of the window of the present invention with the window in a partially opened position.

The window of the present invention is generally illustrated in FIG. 1 which shows a perspective view of the window apparatus 10. The window apparatus 10 generally comprises a casement 12, which fits into a preformed and appropriately sized opening in a wall 14, and a sash 16 which is structured to support at least one pane of glass 18. The outer edge 20 of the casement 12 can be flush with the wall 14 or may extend out from the wall 14 as shown in FIG. 1. The sash 16 is suitably structured to retain a pane of glass 18. However, the sash 16 can also retain any other type of traditional window materials such as plexiglass or screen material.

Figure 2:
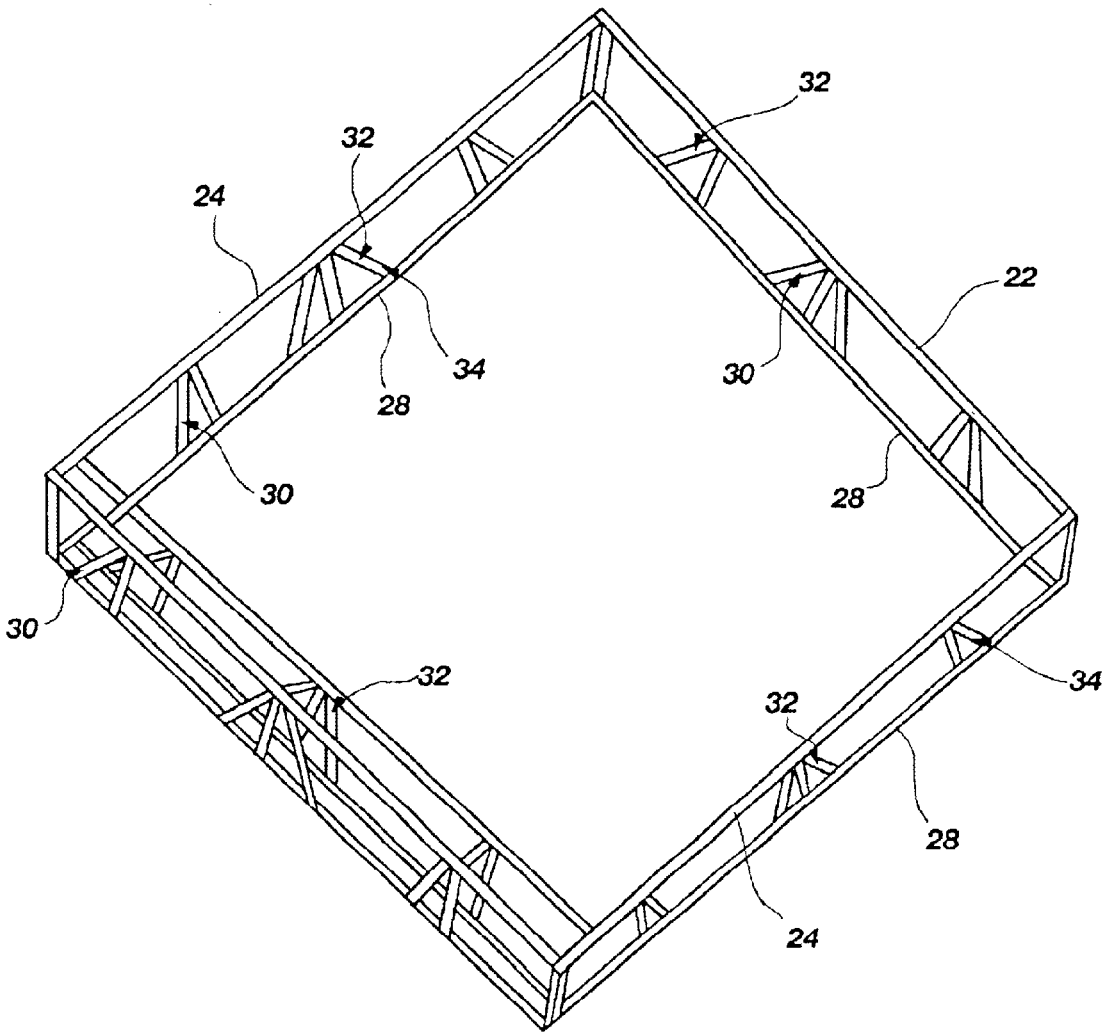
FIG. 2 depicts a perspective view of the structural lattice work of the window.

As shown in FIG. 1, the window comprises a lattice work 22 which is connected to the sash 16 and positioned between the sash 16 and the casement 12. The lattice work 22 provides structural strength to the sash 16. The lattice work 22 may be steel, wood, plastic, composite, or any other material of suitable strength and weight to render the lattice work 22 sufficiently rigid to support the sash 16 and pane of glass 18. In an alternative embodiment, the lattice work 22 and the sash 16 may be formed together as one integral unit. The lattice work 22 as shown in FIG. 2, may be configured with a first perimeter member 24 which is sized and shaped to receive at least a portion of the face 26 (FIG. 12) of the sash 16. The lattice work 22 also comprises a second perimeter member 28 which is comparable in size and shape to the first perimeter member 24 and is spaced from the first perimeter member 24 by struts 30 which are connected by a first end 32 to the first perimeter member 24 and by a second end 34 to the second perimeter member 28.

Figure 3:
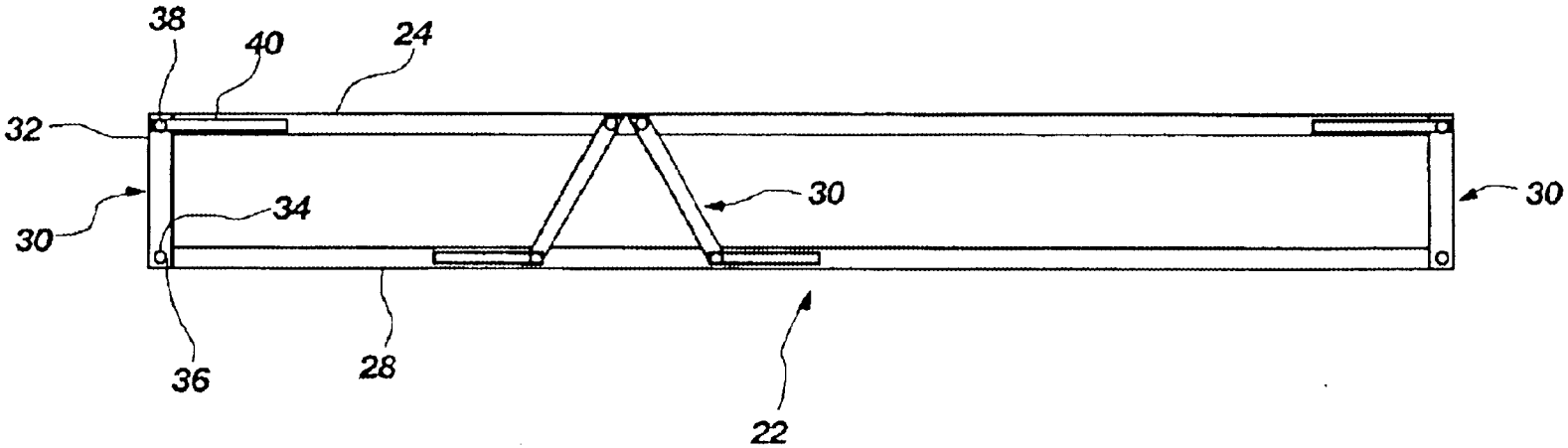
FIG. 3 depicts a side elevation of a collapsible lattice work in the open position.
Figure 4:
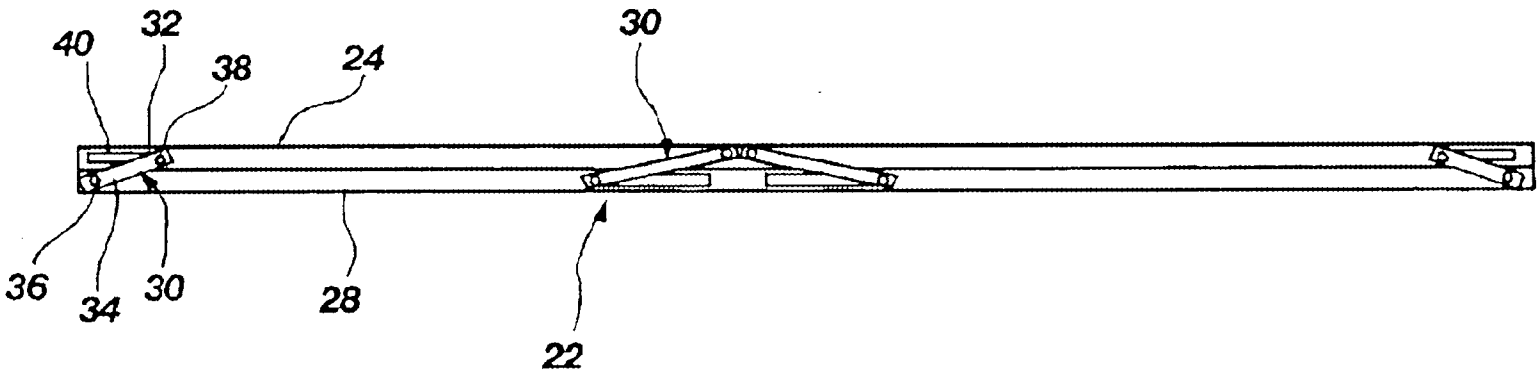
FIG. 4 depicts a side elevation of a collapsible lattice work in the collapsed position.

In one embodiment, the struts 30 may be rigidly affixed to the respective perimeter members 24, 28 thereby maintaining the spaced distance of the first perimeter member 24 from the second perimeter member 28. In an alternative embodiment, shown in FIG. 3, the struts 30 are attached to the perimeter members 24, 28 in such a manner that the lattice work 22 is collapsible. In this embodiment, the struts 30 are attached to the first perimeter member 24 and the second perimeter member 28 in a manner which allows the first perimeter member 24 to be movable from a first position where the first perimeter member 24 is spaced from the second perimeter member 28 to a second position where the first perimeter member 24 registers against the second perimeter member 28 as illustrated in FIG. 4. As one exemplar, shown in FIGS. 3 and 4, the first end 32 and/or the second end 34 of the struts 30 may be secured to their respective perimeter members 24, 28 with a pivot member 36 that allows the strut to rotate around the pivot member 36.

In the alternative, the first end 32 and/or the second end 34 of the struts 30 may be secured to their respective perimeter members 24, 28 with a pin member 38 that is slidably movable within a channel 40 in the perimeter member 24, 28 to which the strut 30 is attached with the pin member 38. This configuration allows the end 32, 34 of the strut 30 secured with a pivot member 36 to rotate around the pivot member 36, as the end 32, 34 of the strut 30 that is secured with a pin member 38, slides within the channel 40 as the first perimeter member 24 moves toward the second perimeter member 28.

FIG. 4 illustrates the lattice work 22 in a closed position. The ends 32, 34 of each strut 30 secured with a pin member 38 have moved along the channel 40 as the ends 32, 34 of each strut 30 secured with a pivot member 36 rotates around the pivot member 36. This arrangement allows the perimeter members, 24, 28 to move with respect to each other from an extended position where the first perimeter member 24 is spaced from the second perimeter member 28 (FIG. 3), to a closed position where the first perimeter member 24 registers against the second perimeter member 28 (FIG. 4).

Figure 5:
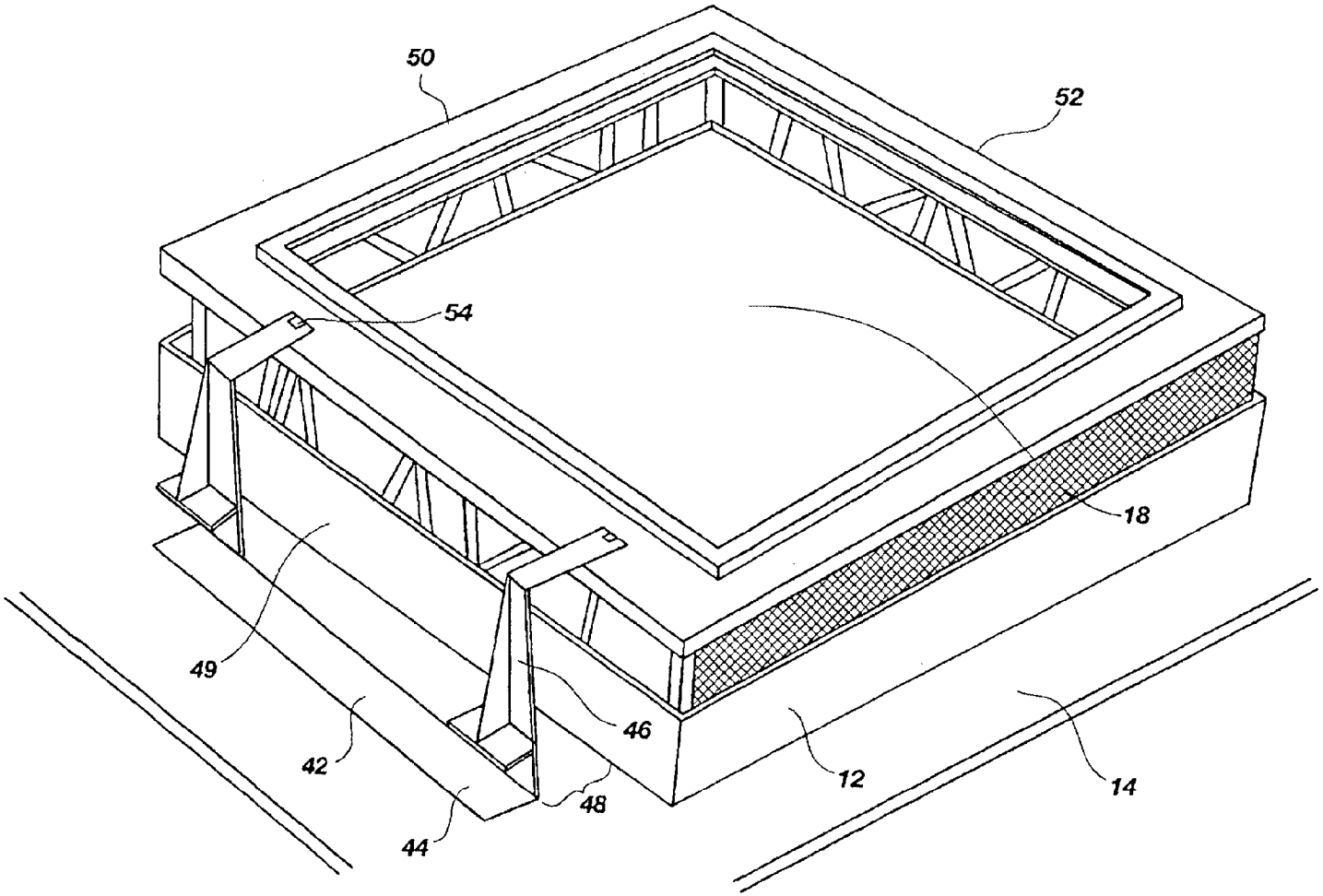
FIG. 5 depicts a perspective view of the window with the mounting bracket positioned at a distance from the casing.

Returning now to FIG. 1, a support bracket 42 is affixed to the wall 14. The support bracket 42 is the supporting element of the window apparatus 10. The support bracket 42 projects horizontally outward from the wall in which the window is located. As used herein, the word "horizontal" when used to describe the support bracket and the elements comprising the support bracket, means an orientation that is perpendicular to the long axis of the casement. The support bracket 42 is non-moving and is of fixed length. The support bracket 42 has a mounting plate 44 which is used to attach the support bracket 42 to the wall 14. As depicted in FIG. 1, the mounting plate 44 is flush with the wall 14. The support bracket 42 has horizontal beams 46 which project from the mounting plate 44. The horizontal beams 46 may contact the casement 12 as depicted in FIG. 1. However, the horizontal beams 46 may alternatively be positioned such that they are not in contact with the casement 12. FIG. 5 illustrates an alternative embodiment in which the horizontal beams 46 are located at a distance 48 from the casement 12 and thus, do not contact the casement 12. However, the support bracket 42 supports the sas more fully below.

While two horizontal beams 46 are depicted in FIG. 1, alternative embodiments may comprise only one horizontal beam 46 or more than two horizontal beams 46. The horizontal beams 46 may be located at the bottom 49 of the window apparatus 10 or to the sides 50 or at the top 52 of the window apparatus 10. Each horizontal support bracket beam 46 acts as a support for a shaft 54 (shown in phantom) on which a roller housing 56 (FIG. 10) is positioned. The shaft 54 passes through an opening 55 in the sash 16.

Figure 6:
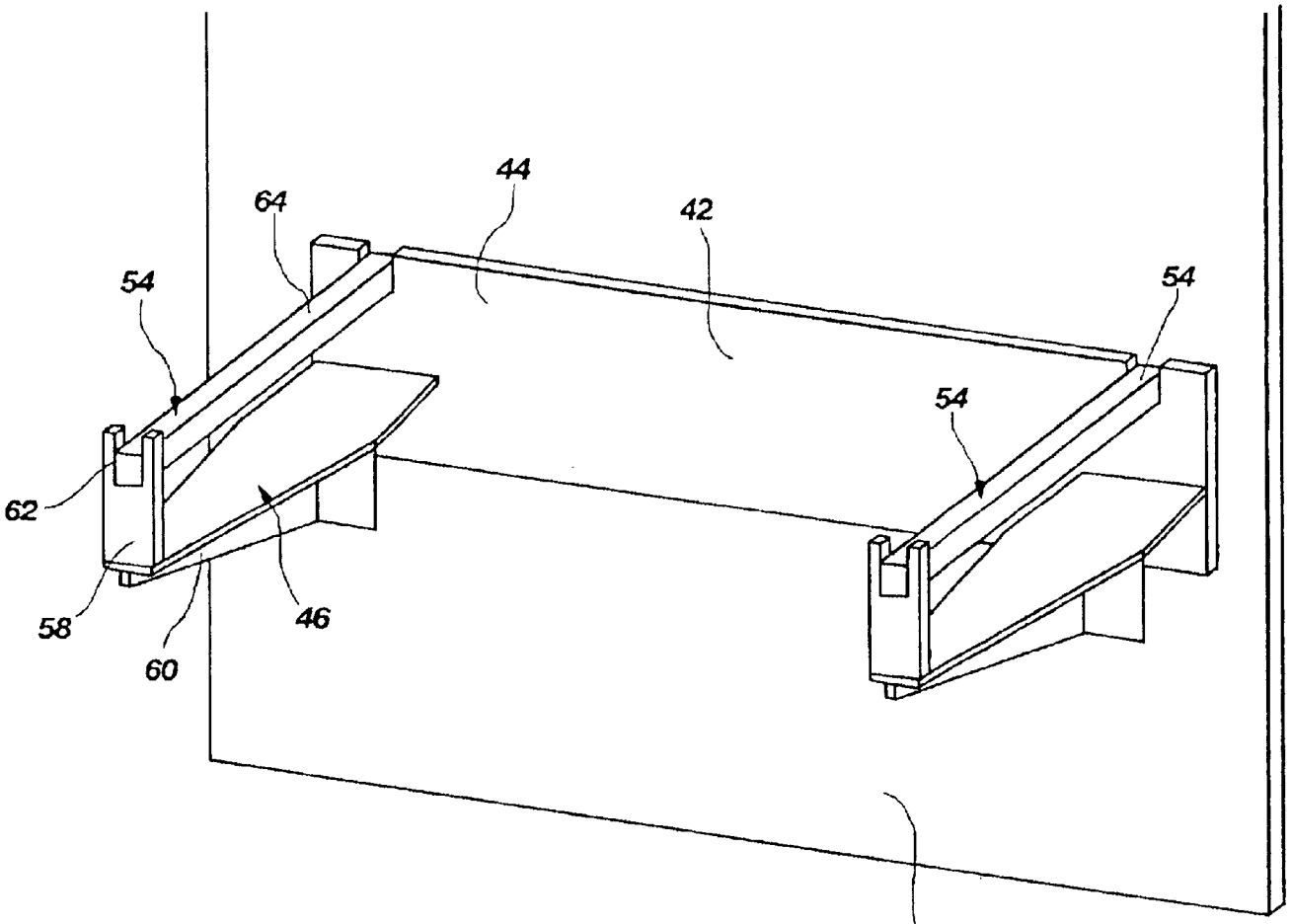
FIG. 6 depicts a perspective view of the horizontal exterior supports.

FIG. 6 shows a perspective view of the support bracket 42 with the shafts 54 supported by the horizontal beam 46. In the embodiment depicted in FIG. 6, the horizontal beam 46 includes a vertical support 58 at its first end 60 that supports the first end 62 of the shaft 54. A second end 64 of the shaft 54 is supported by the mounting plate 44. In the depicted embodiment, the shaft 54 is oriented more or less parallel to the horizontal beam 46. However, it is not necessary that the horizontal beam 46 and shaft 54 be parallel. The horizontal beam 46 and the shaft 54 may have any orientation with respect to each other and with respect to the wall 14 so long as the shaft 54 is oriented in the direction of travel of the sash 16 (FIG. 1). In addition, while the shaft 54 depicted in FIG. 6 has a more or less square cross section, the shaft 54 can have a cross section consisting of any geometric shape including a circle, oval, rectangle, etc.

Figure 7:
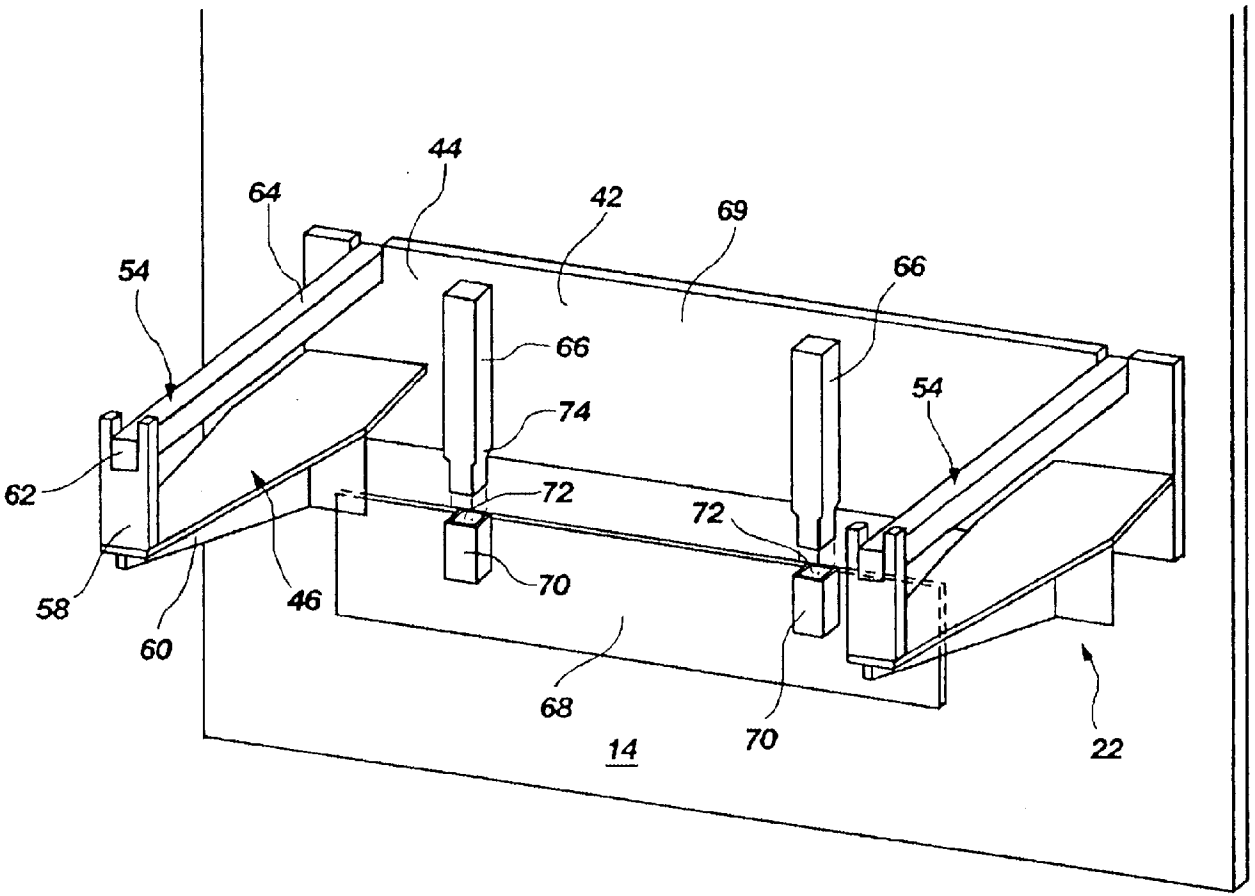
FIG. 7 depicts a perspective view of the horizontal supports with a detachable fastening bracket.

In the embodiment of FIG. 6, the mounting plate 44 is an integral part of the support bracket 42 itself. However, in an alternative embodiment, illustrated in FIG. 7, the support bracket 42 comprises a mounting bracket 68 and a detachable support assembly 69. In this embodiment, mounting posts 66 are affixed to the detachable support assembly 69. The horizontal beams 46 are affixed to the detachable support assembly 69. The mounting bracket 68 is affixed to the wall 14. Affixed to the mounting bracket 68 are receiving members 70. The receiving members 70 contain recesses 72 sufficient to receive an end 74 of the mounting post 66. The mounting post 66 is configured such that each mounting post end 74 can be inserted into a recess 72 of a corresponding receiving member 70.

Figure 8:
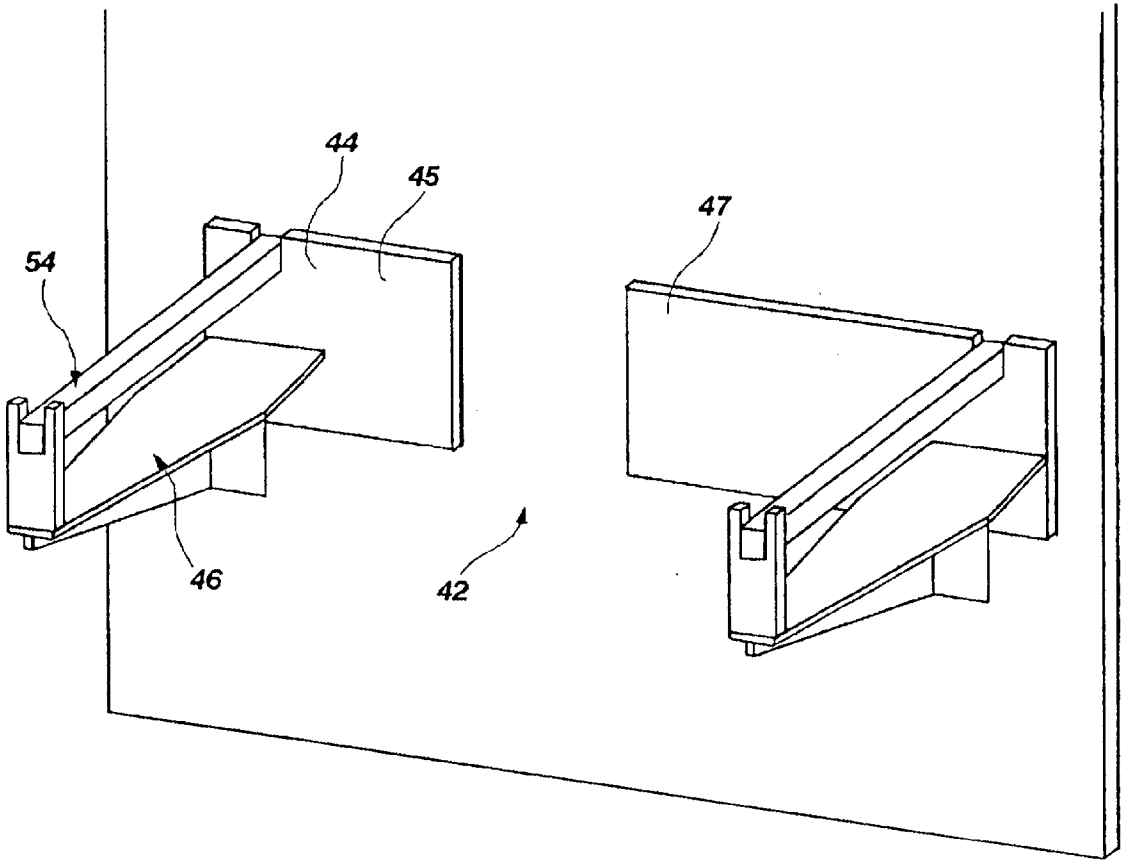
FIG. 8 depicts a perspective view of horizontal support comprised of two independent parts.

In yet another embodiment, illustrated in FIG. 8, the support bracket 42 comprises at least two separate parts 45, 47, each of which supports at least one horizontal beam 46. The mounting plates 44 may then be positioned relative to each other to accommodate windows 10 of varying sizes.

Figure 9:
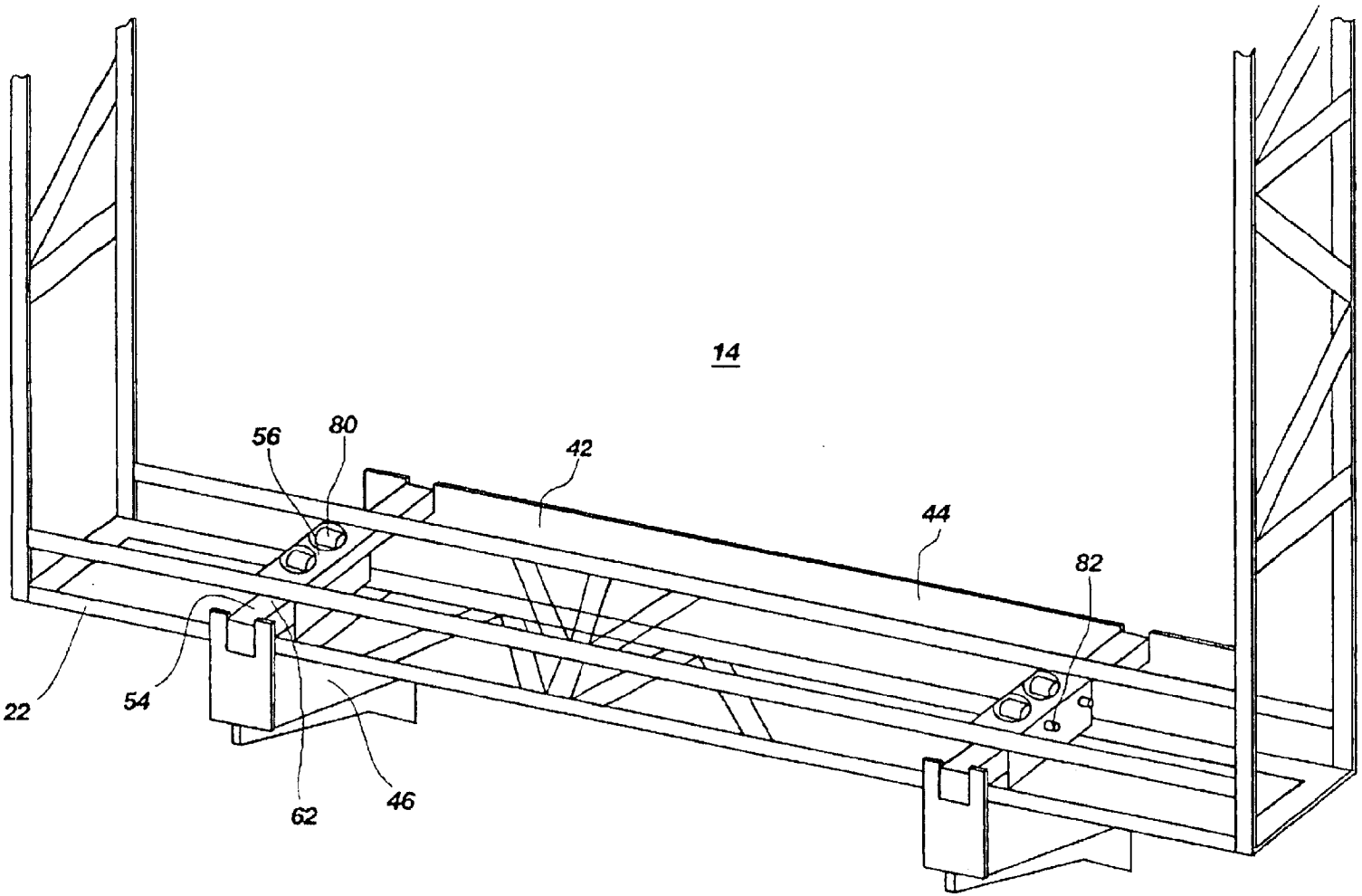
FIG. 9 depicts a partial view in perspective of the structural lattice work and the horizontal exterior support.
Figure 10:
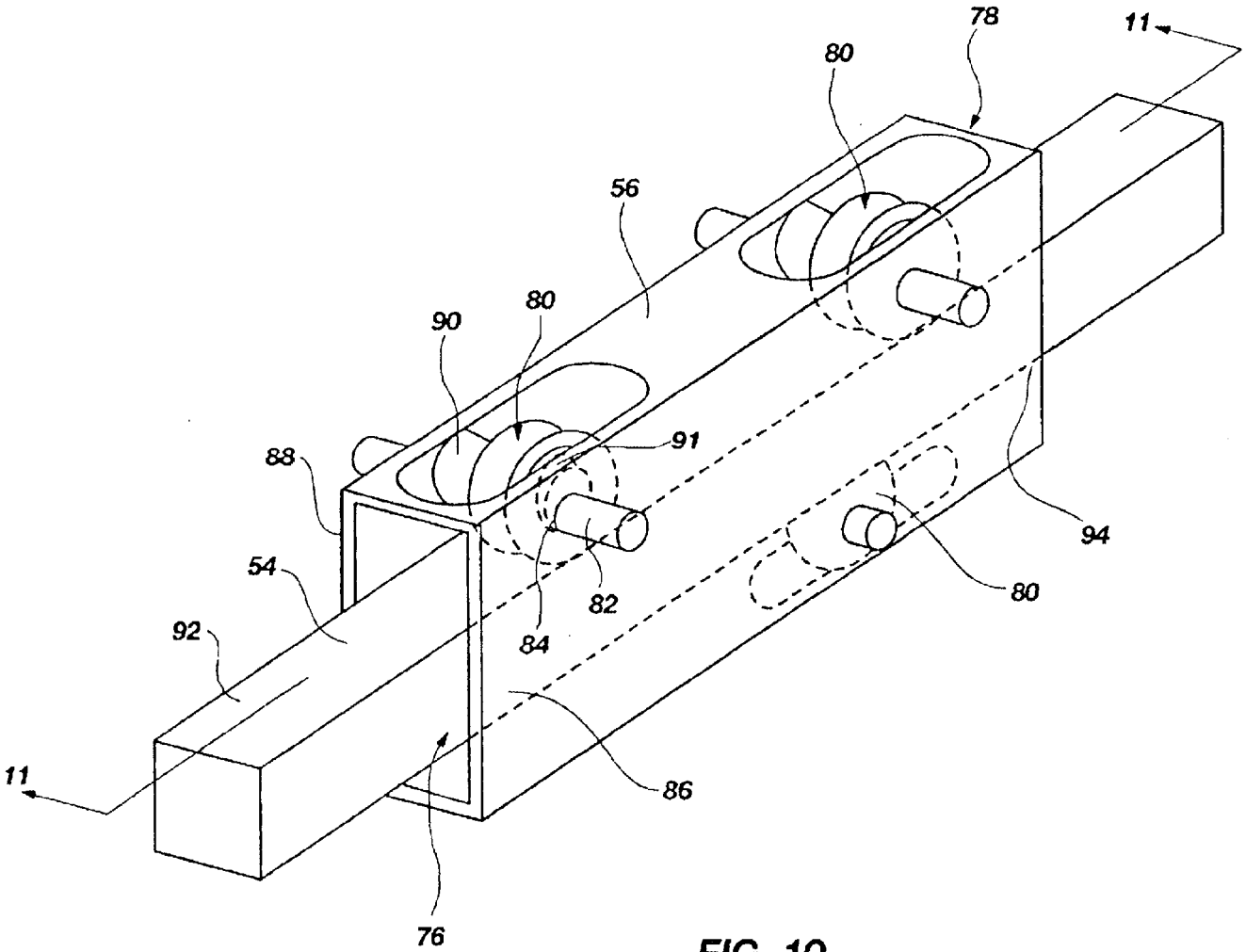
FIG. 10 depicts a perspective view of the roller mechanism.

FIG. 9 is a partial illustration of the lattice work 22, the roller housing 56 and the mounting plate 44. The roller housing 56 is affixed to the lattice work 22 by welding, bolts, screws, rivets, glue or any other means known to the art. The shaft 54 extends through the roller housing 56. FIG. 10 illustrates a closeup view of the roller housing 56. The roller housing 56 is a hollow structure made of steel or some other structurally rigid material and is open at both the first end 76 and second end 78 thereof. The shaft 54 extends through the roller housing 56, extending through both the first end 76 and the second end 78 of the roller housing 56. A plurality of rollers 80 are positioned in the roller housing 56 via roller axles 82 which pass through appropriately sized holes 84 formed in the side walls 86, 88 in the roller housing 56. A roller spacer 90 is positioned on one side of the roller 80. A second roller spacer 91 (shown in phantom), is positioned on the other side of the roller 80. The roller spacers 90, 91 maintain the position of the rollers 80 within the roller housing 56. Rollers 80 are positioned to be in contact with both the first surface 92 and second surface 94 of the shaft 54, the first surface 92 and second surface 94 being located at opposite sides of the shaft 54.

Figure 11:
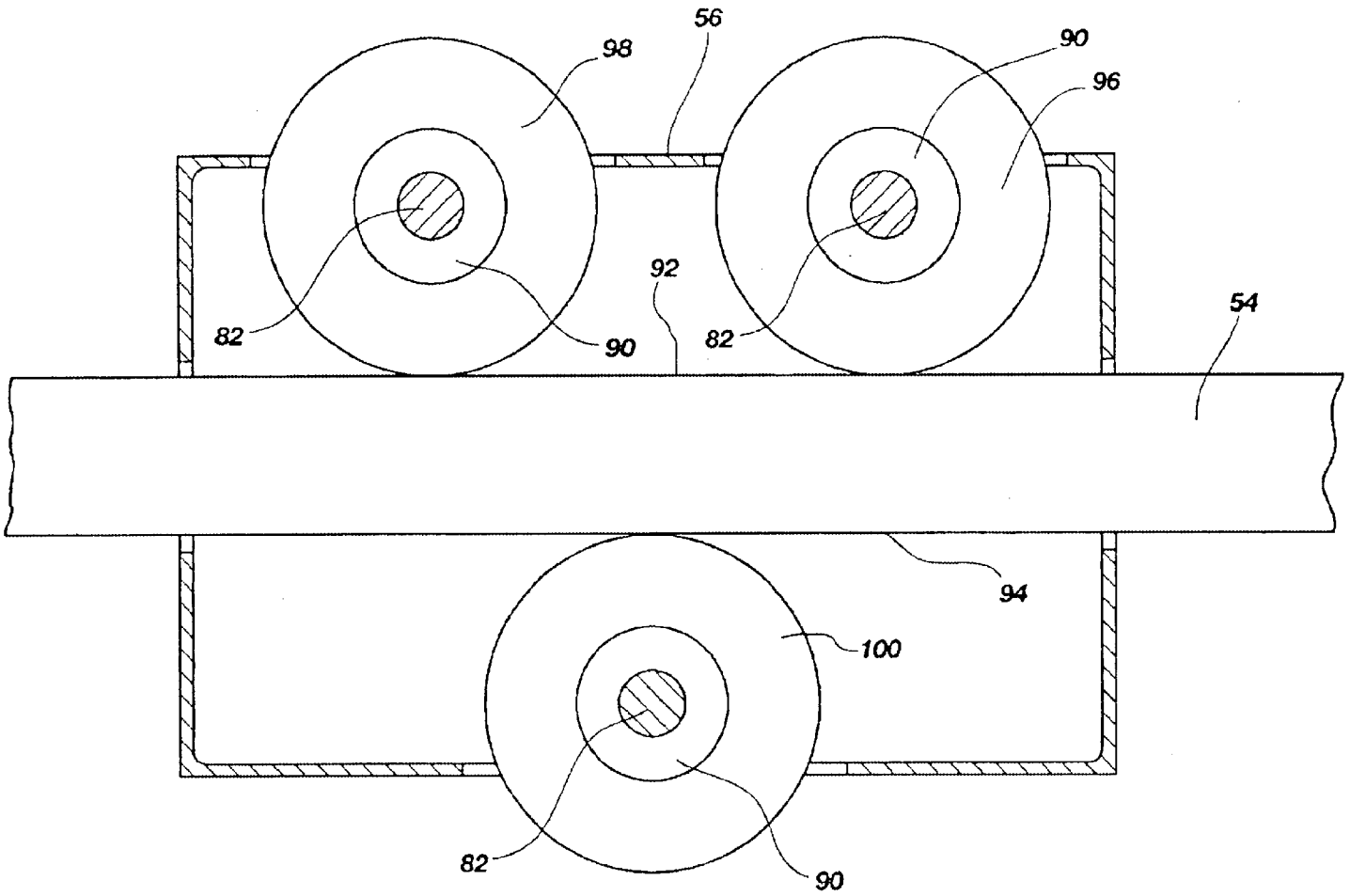
FIG. 11 depicts a view in longitudinal cross section of the roller mechanism shown in FIG. 10 taken at line 11—11 and illustrates the positioning of the rod within the roller mechanism.

FIG. 11 illustrates a longitudinal cross section of the roller housing 56 shown in FIG. 10 taken at line 11—11. A first roller 96 and second roller 98 are positioned to contact the first surface 92 of the shaft 54. A third roller 100 is positioned to contact the second surface 94 of the shaft 54. The third roller 100 is offset from the first roller 96 and second roller 98. The positioning of the rollers 96, 98, 100 maintains the position of the shaft 54 with respect to the roller housing 56.

Returning to FIG. 9, there is illustrated the manner in which the lattice work 22 is supported by the shaft 54 as well as the manner in which the shaft 54 is supported by the horizontal beam 46. The roller housing 56 is affixed to the lattice work 22. The roller housing 56 is supported by the shaft 54 by virtue of the rollers 80 being in contact with the shaft 54. Thus, the weight of the lattice work 22 is transferred to the shaft 54. Because the support bracket 42 is affixed to the wall 14, the weight of the lattice work 22 is transferred to the wall 14 via the roller housing 56, the rollers 80, the shaft 54, the horizontal beam 46 and the support bracket 42. The lattice work 22 can move in either direction between the first end 62 of the shaft 54 and the mounting bracket 42 with very little effort due to the fact that the rollers 80 allow the lattice work 22 to roll along the shaft 54 with very little resistance.

The rollers 80 and roller housing 56 depicted here illustrate one possible method for movably affixing the lattice work 22 to the shaft 54. However, this object can be accomplished by other methods such as roller bearings, or direct contact between the shaft 54 and the lattice work 22 such that the lattice work 22 actually slides along the shaft 54. Alternatively, the roller housing 56 can be affixed to the support bracket 42 while the shaft 54 can be affixed to the lattice work 22 in such a manner that the shaft 54 moves back and forth through the roller housing 56, while the roller housing 56 remains stationary.

Figure 12:
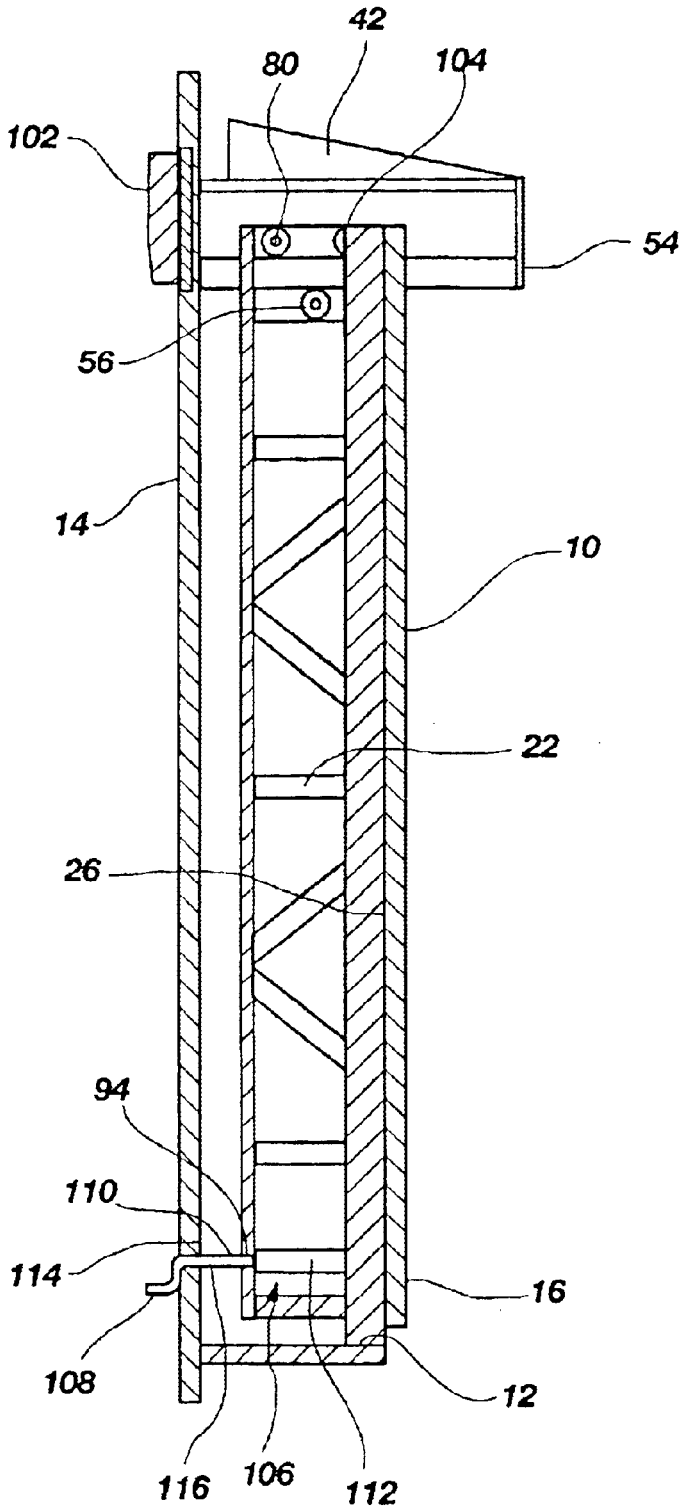
FIG. 12 depicts a longitudinal cross sectional view of an alternative embodiment of the window.

FIG. 12 illustrates a longitudinal cross sectional view of an alternative embodiment of the window 10 shown in FIG. 1, wherein the sash 16 along with the lattice work 22 is suspended from the shaft 54. In this embodiment, the support bracket 42 is affixed to the header 102 of the building in which the window is located. The roller housing 56 is located at the upper portion 104 of the lattice work 22. The roller housing 56 is supported by the shaft 54 by virtue of the rollers 80 being in contact with the shaft 54. Because the lattice work 22 is affixed to the roller housing 56 and the sash 16 is affixed to the lattice work 22, the sash 16 and lattice work 22 are supported by the horizontal beams 46. FIG. 12 also illustrates the manner in which an opener 106 may be affixed to the window 10. The opener 106 may be any suitable mechanism, including manual opening means, electro-mechanical means, hydraulic opening means or solar-powered means. In this instance, the opener 106 is a very simple mechanical (non-motorized) means comprising a crank 108 attached to a threaded pin 110. The threaded pin 110 is inserted inside a threaded shaft 112. The crank 108 extends through a hole 114 in the wall 14. A bearing 116 surrounds the crank 108 where the crank 108 passes through the hole 114 in the wall 14. The threaded shaft 112 is affixed to the sash 16 and/or lattice work 22 by appropriate means. As the crank 108 is rotated, it rotates the threaded pin 110, which in turn rotates inside the threaded shaft 112. As the threaded pin 110 rotates inside the threaded shaft 112, the threaded shaft 112 is moved either closer to or farther away from the wall 14. Because the threaded shaft 112 is affixed to the sash 16 and/or lattice work 22, movement of the threaded shaft 112 causes the sash 16 and the lattice work 22 to move either closer to or farther away from the wall 14.

Figure 13:
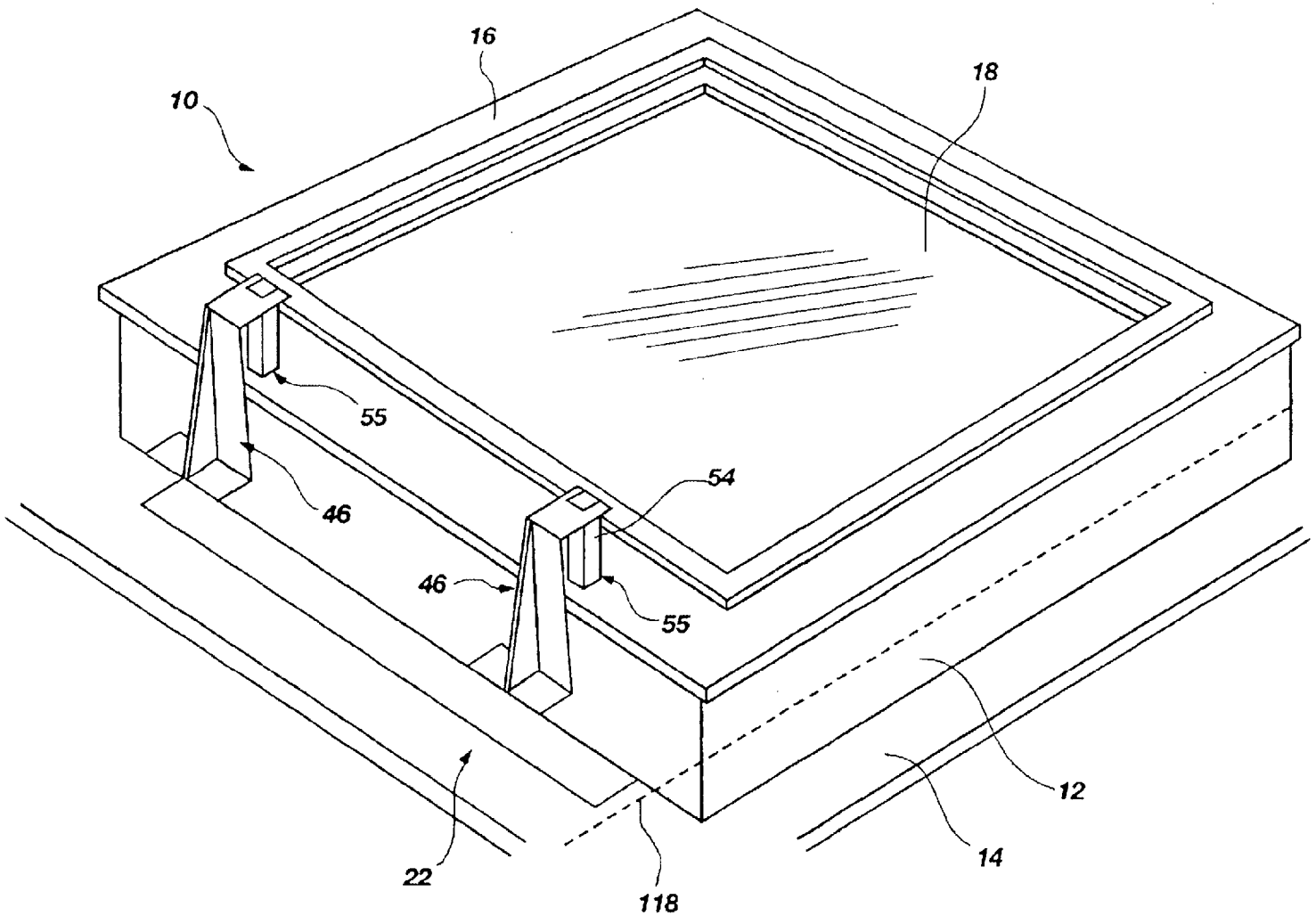
FIG. 13 depicts a perspective view of the window in a closed position.
Figure 14:
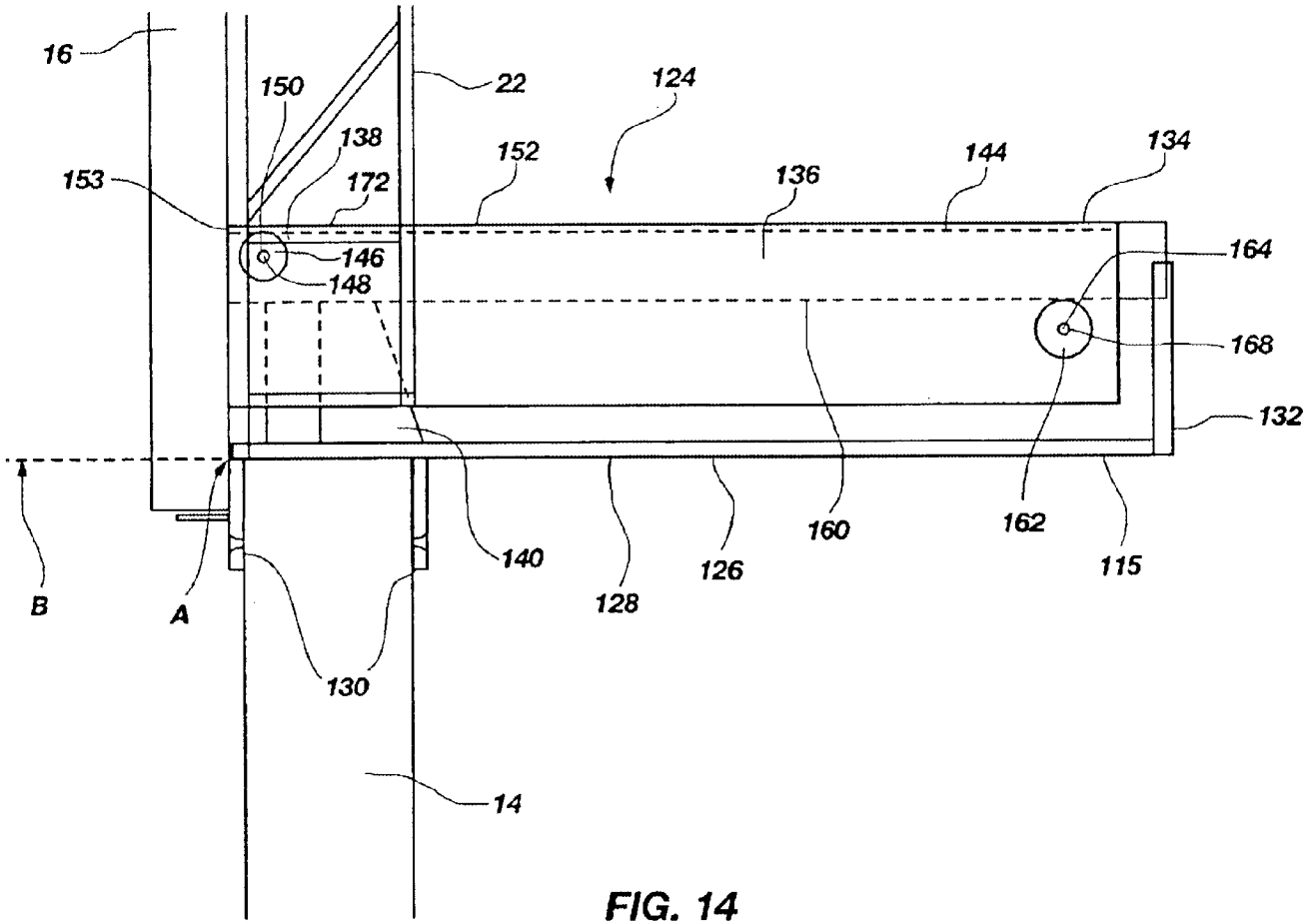
FIG. 14 depicts a side view in partial cross section of an alternative embodiment of the window in which the horizontal support is cantilevered toward the interior of the building (shown in cross section) in which the window is mounted.

FIG. 13 illustrates the window 10 in a closed position while FIG. 1 illustrates the window 10 in an open position. It can be seen that the window sash 16 moves horizontally outward from its position in registration against the casement 12 as shown in FIG. 13. As used herein, the word "horizontal", when used to describe the opening of the window sash 16, means that the window sash 16 moves inwardly toward and outwardly from the casement 12 in a direction which is perpendicular to the plane of the wall 14. In the open position depicted in FIG. 1, an opening 120 is created between the window sash 16 and the casement 12. This opening allows for ventilation through the window apparatus 10. To prevent insects or rain from entering through the window apparatus 10 when it is in the open position, a ventilation skirt 122 can be positioned about the periphery of the window sash 16 (i.e., about all four sides) or inside the lattice work 22 and is preferably interconnected between the casement 12 and the sash 16 about all four sides of the window 10. The ventilation skirt 122 is structured to move outwardly with the structural lattice work 22 and/or sash 16 as the sash 16 moves horizontally outwardly from the casement 12.

FIGS. 14, 15, 16 and 17 illustrate an alternative embodiment of the window apparatus 124 wherein the support element 126 projects into the interior of the building in which the window apparatus 124 is mounted. The support element 126 comprises a horizontal member 128 that is oriented more or less parallel to the sash's 16 direction of travel. The support element 126 also comprises a fastening element 130. The fastening element 130 serves as the means for attaching the support element 126 to the wall 14. The support element 126 has a first vertical support post 132 that supports the first end 134 of a rail 136. The rail 136 has a second end 138 that is supported by a second vertical support post 140. The second vertical support post 140 is positioned at a point between the first vertical support post 132 and the second end 138 of the rail 136.

Figure 15:
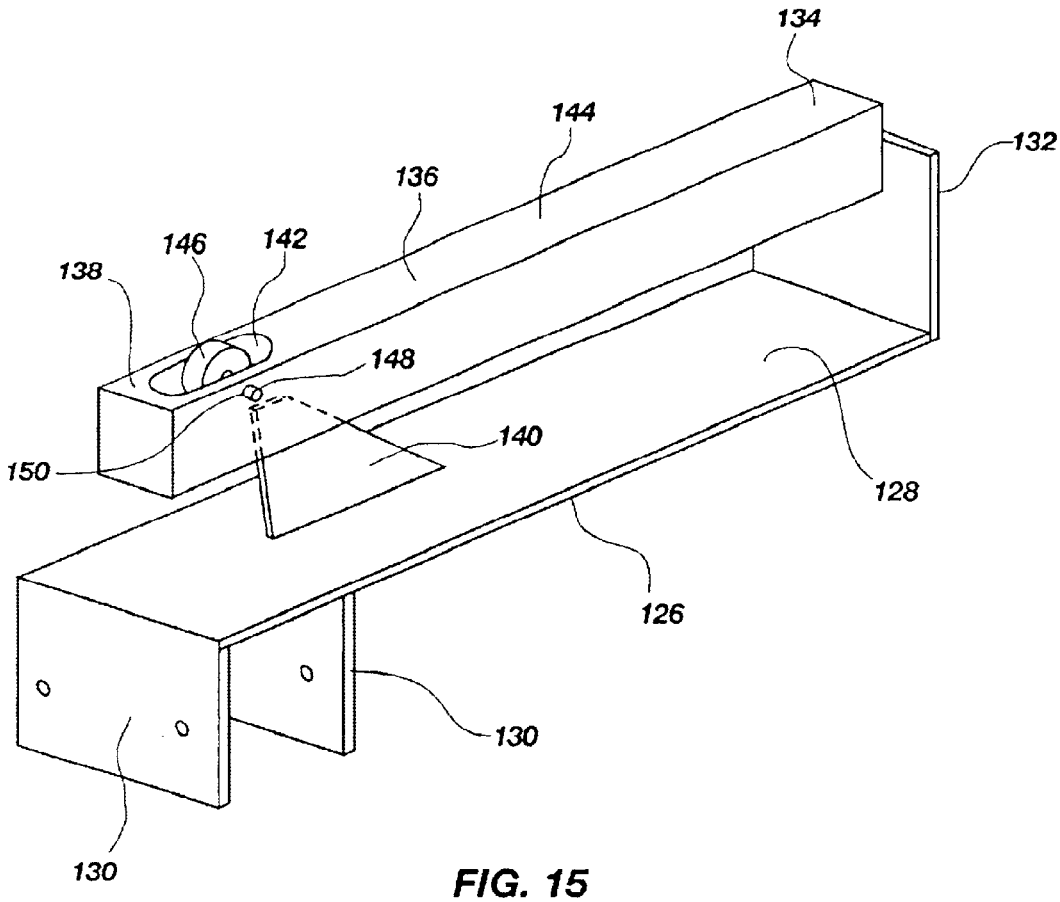
FIG. 15 depicts a perspective view of the support and rail of the alternative embodiment of FIG. 14.

FIG. 15 shows a perspective view of the support element 126 and the rail 136. This view shows the manner in which the first end 134 of the rail 136 is supported by the first vertical support element 132. This view also shows the manner in which the second end 138 of the rail 136 is supported by the second vertical support element 140. The second vertical support element 140 can be located anywhere between the second end 138 of the rail 136 and the first vertical support element 132. The rail 136 also contains a recess 142 in its upper surface 144. Inside this recess 142 is mounted a first roller 146. The first roller 146 is connected to the rail 136 by an axle 148 that passes through a hole 150 in the rail 136 and through the first roller 146 in such a way that the first roller 146 can rotate. The first roller 146 is also positioned so that a portion of the first roller 146 extends beyond the upper surface 144 of the rail 136.

Figure 16:
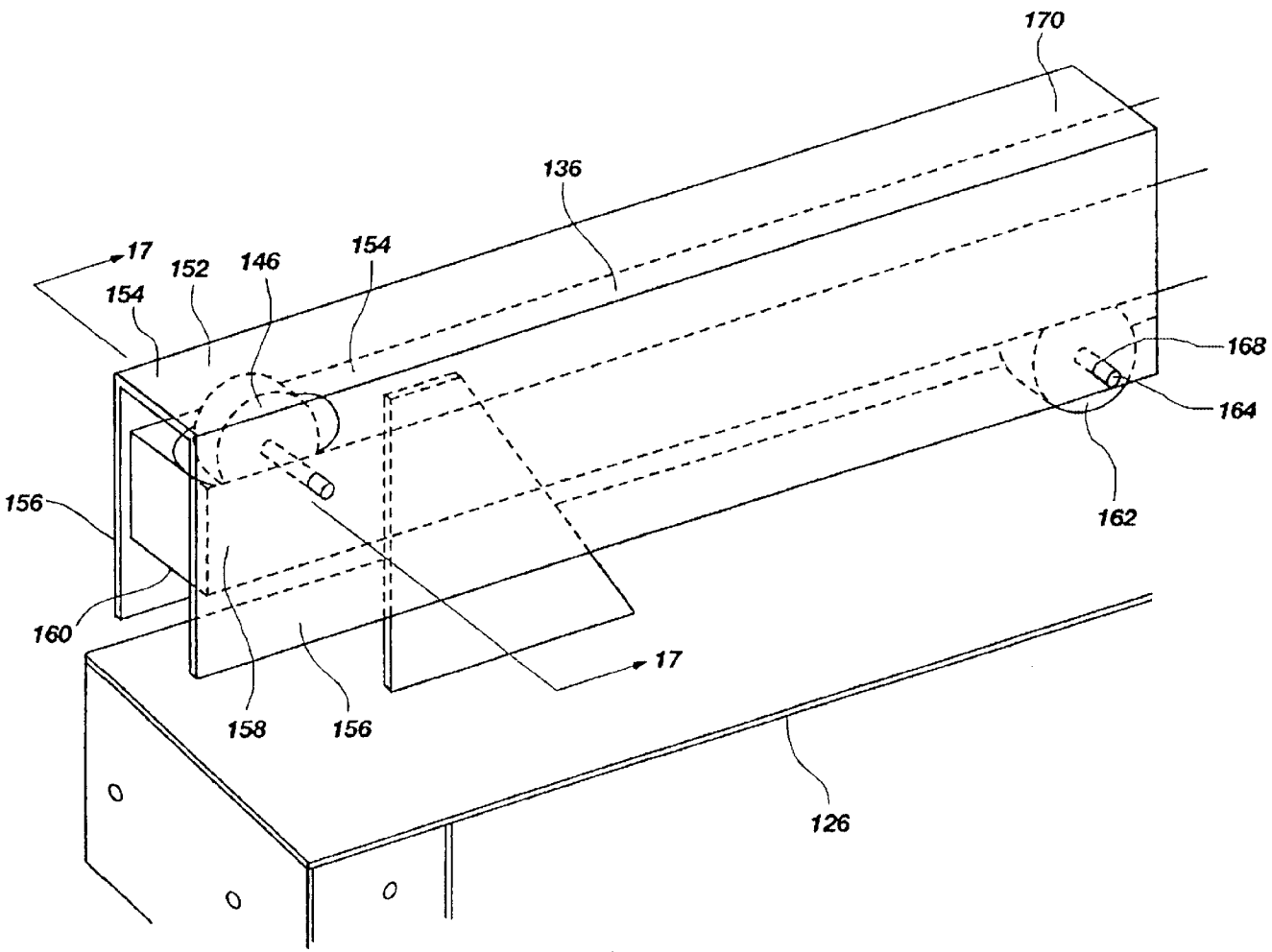
FIG. 16 depicts a partial perspective view of the support and rail of FIG. 14, wherein the rail supports a trolley.
Figure 17:
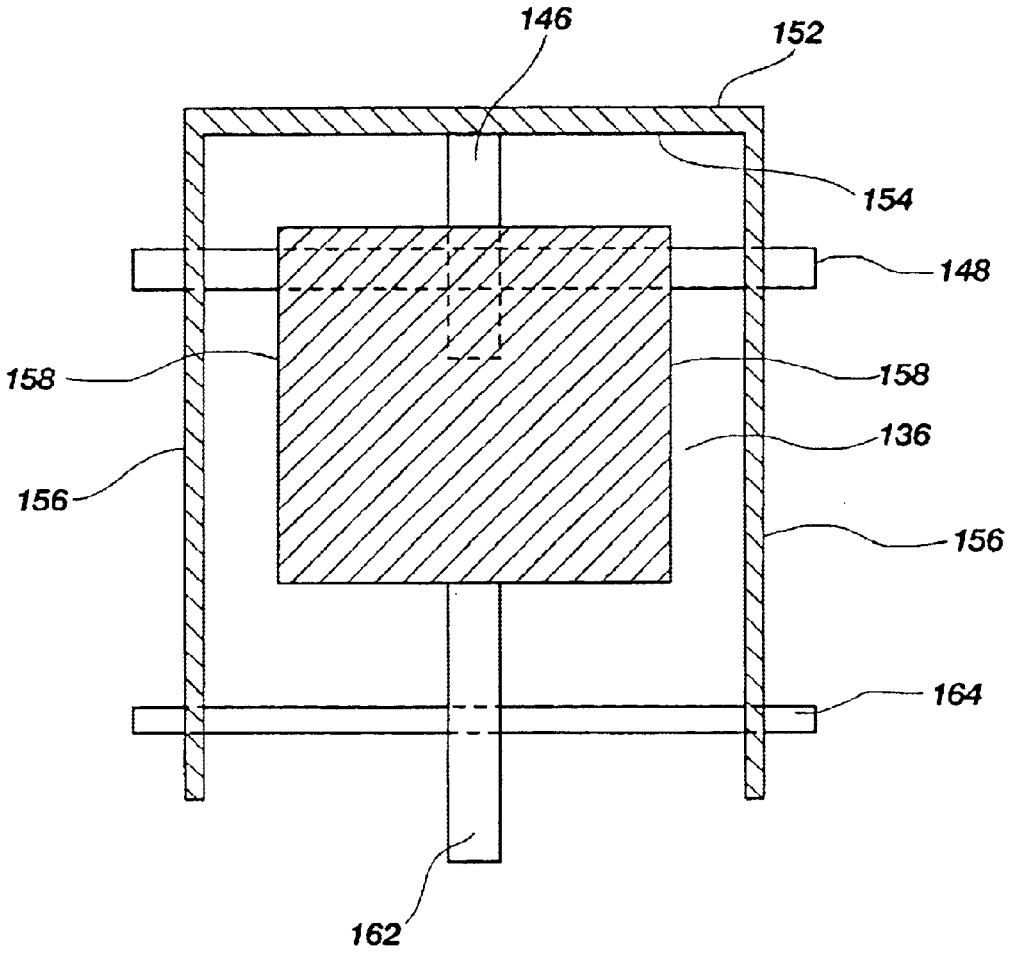
FIG. 17 depicts a cross section of the rail and the trolley depicted in FIG. 16 and taken at line 17—17.

FIG. 16 shows a partial perspective view of the support element 126 and the rail 136. In this figure, a trolley 152 is positioned so that its first side 154 rests on the first roller 146. The trolley 152 has two lateral sides 156 that extend beyond the lateral edges 158 of the rail 136 such that the lateral sides 156 of the trolley 152 do not contact the lateral edges 158 of the rail 136. FIG. 17 is a cross-sectional view of the trolley 152 and rail 136 and illustrates the manner in which the lateral sides 156 extend beyond the lateral edges 158 of the rail 136. Returning to FIG. 16, the lateral sides 156 of the trolley 152 also extend beyond the lower surface 160 of the rail 136. A second roller 162 is connected to the lateral sides 156 of the trolley 152 with an axle 164 that passes through a hole 168 in the lateral sides 158 of the trolley 152 and through the second roller 162 in such manner that the second roller 162 can rotate. The second roller 162 is positioned at point between the first roller 146 and the second end 170 of the trolley 152. The second roller 162 is also positioned such that it makes contact with the lower surface 160 of the rail 136. The first roller 146 and the second roller 162 provide the contact points between the rail 136 and the trolley 152 and allow the trolley 152 to travel back and forth along the rail 136. Although two rollers are illustrated in FIG. 15, more than two rollers can be used.

Returning to FIG. 14, the lattice work 22 is attached to the first end 172 of the trolley 152. The trolley 152 is supported by the rollers 146, 162 as its moves back and forth along the rail 136. The front 153 of the trolley 152, moves between point A in the closed position and point B in the open position. The lattice work 22 and the sash 16, being connected to the trolley 152 move between the open and closed position as they move back and forth with the trolley 152. Reference herein to specific details of the illustrated embodiments is by way of example and not by way of limitation. It will be apparent to those skilled in the art that many additions, deletions and modifications to the illustrated embodiments of the invention may be made without departing from the spirit and scope of the invention as defined by the following claims.

What is claimed is:

1. A horizontally openable window comprising:

a window sash;

a rigid lattice work structure connected to said window sash and providing load bearing support to said window sash in movement from an open position to a closed position;

a horizontally disposed non-moving support member of fixed length positioned to support said rigid lattice work structure as said rigid lattice work and supported window sash travel horizontally between an open and a closed position rigidly perpendicular to said non-moving support member;

a movement facilitating member in contact with said rigid lattice work structure and slidably moveable along said horizontally disposed non-moving support member; and an apparatus for moving said window sash between an open position and closed position.

2. The horizontally openable window of claim 1 further comprising a casement positioned to receive said window sash in registration therewith.

3. The horizontally openable window of claim 2 wherein said horizontally disposed non-moving support member of fixed length is positioned to contact said casement.

4. The horizontally openable window of claim 2 wherein said horizontally disposed non-moving support member of fixed length is spaced from said casement.

5. The horizontally openable window of claim 1 wherein said rigid lattice work is configured to be collapsible while still providing support for said window sash.

6. The horizontally openable window of claim 1 wherein said non-moving support member of fixed length comprises:

a mounting bracket; and a support bracket which is removably connected to said mounting bracket.

7. The horizontally openable window of claim 1 wherein said non-moving support member of fixed length further comprises at least two separate support elements each having at least one mounting plate and at least one horizontal beam and at least one shaft.

8. The horizontally openable window of claim 1 wherein said horizontally disposed non-moving support member of fixed length comprises a first end and a second end, and wherein said rigid lattice work structure is moveable between said first end of said horizontally disposed non-moving support member and said second end of said horizontally disposed non-moving support member.

9. The horizontally openable window of claim 1 wherein said horizontally disposed non-moving support member of fixed length comprises a first end and a second end, and wherein said window sash is moveable from a first closed position in proximity to said first end of said horizontally disposed non-moving support member to a second open position spaced from both said first end and said second end of said horizontally disposed non-moving support member.

10. The horizontally openable window of claim 1 wherein said movement facilitating member comprises rollers.

11. The horizontally openable window of claim 1 wherein said movement facilitating member comprises bearings.

12. The horizontally openable window of claim 1 wherein said window sash and rigid lattice work are formed as one integral unit.

13. The horizontally openable window of claim 1 wherein said rigid lattice work is comprised of material selected from the group comprising: steel, aluminum, titanium, wood, plastic, fiberglass, and combinations thereof.

14. The horizontally openable window of claim 1 wherein said apparatus for moving said sash between an open and closed position comprises at least one pin telescopingly received in a hollow shaft connected to said sash for effecting selectively adjustable movement of said window sash.

15. A friction reducing mechanisms comprising:

a rigid lattice work structure configured to attach to a window sash of a horizontally openable window to provide load bearing support to a window sash in movement between an open position and a closed position and to rigidly support said window sash in an open position;

a horizontally disposed non-moving support member of fixed length structured to support said rigid lattice work and window sash; and at least one movement facilitating member slidably connected to said horizontally disposed non-moving support member of fixed length, said at least one movement facilitating member being structured to receive and support said rigid lattice work structure supporting a window sash.

16. The friction reducing mechanism for facilitating the movement of a horizontally openable window of claim 15 wherein said movement facilitating member comprises at least one roller.

17. The friction reducing mechanism for facilitating the movement of a horizontally openable window of claim 15 wherein said non-moving support member has a first end and a second end, and said movement facilitating member is structured to slide between said first end and said second end of said non-moving support.

18. The friction reducing mechanism of claim 15 wherein said non-moving support member has a first end and a second end, and said movement facilitating member is structured to slidably move from a first position in proximity to said first end of said non-moving support member to a second position distanced from both said first end and said second end of said non-moving support member.

19. A horizontally openable window comprising:

a window sash;

a rigid lattice work structure connected to said window sash and providing load bearing support of said window sash in movement from an open position to a closed position;

a horizontally disposed non-moving support member of fixed length positioned to support said rigid lattice work structure as it travels horizontally between an open and closed position; and a movement facilitating member in contact with said lattice work structure and slidably moveable along said horizontally disposed non-moving support member.

* * * * *